US006360387B1

(12) United States Patent
Everhart

(10) Patent No.: US 6,360,387 B1
(45) Date of Patent: Mar. 26, 2002

(54) FERTILITY PILLOW

(76) Inventor: Mirchana S. Everhart, 616 Helen St., Lake Charles, LA (US) 70601

( * ) Notice: Subject to any disclaimer, the term of this patent is extended or adjusted under 35 U.S.C. 154(b) by 0 days.

(21) Appl. No.: 09/688,937

(22) Filed: Oct. 16, 2000

(51) Int. Cl.[7] ..... A47C 20/00; A47G 9/00

(52) U.S. Cl. ..... 5/630; 5/632; 5/490; 5/922; 5/929

(58) Field of Search ..... 5/630, 632, 633, 5/636, 639, 643, 648, 652, 655.9, 490, 922, 923, 929, 953

(56) References Cited

U.S. PATENT DOCUMENTS

| | | | | | |
|---|---|---|---|---|---|
| 1,890,358 | A | * | 12/1932 | Barcalo | 5/633 X |
| 1,928,806 | A | * | 10/1933 | Barcalo | 5/639 |
| 1,934,254 | A | * | 11/1933 | Barcalo | 5/639 |
| 2,314,080 | A | * | 3/1943 | Dine et al. | 5/630 |
| 2,593,319 | A | * | 4/1952 | Levitin et al. | 5/633 X |
| 2,857,957 | A | | 10/1958 | Gay | 155/153 |
| 3,003,815 | A | * | 10/1961 | Zinn | 5/630 X |
| 3,137,012 | A | * | 6/1964 | Halterman | 5/633 |
| 3,284,817 | A | * | 11/1966 | Landwirth | 5/630 X |
| 3,389,411 | A | * | 6/1968 | Emery | 5/636 X |
| D211,721 | S | * | 7/1968 | Radford | 5/636 X |
| 3,555,582 | A | * | 1/1971 | Radford | 5/632 |
| 3,648,308 | A | * | 3/1972 | Greenawalt | 5/632 |
| 3,938,205 | A | * | 2/1976 | Spann | 5/632 |
| 4,105,249 | A | * | 8/1978 | Van Vliet, Jr. | 297/230.12 |
| 4,214,326 | A | * | 7/1980 | Spann | 5/632 |
| 4,233,700 | A | * | 11/1980 | Spann | 5/632 |
| 4,635,306 | A | * | 1/1987 | Willey | 5/632 |
| 4,780,921 | A | | 11/1988 | Lahn et al. | 5/437 |
| 4,802,249 | A | | 2/1989 | Bills | 5/420 |
| 4,815,154 | A | * | 3/1989 | Grimes | 5/490 X |
| 4,862,535 | A | * | 9/1989 | Roberts | 5/922 X |
| 4,970,742 | A | * | 11/1990 | Keener | 5/633 |
| 5,014,376 | A | * | 5/1991 | Doran et al. | 5/603 |
| 5,029,350 | A | | 7/1991 | Edelson | 5/431 |
| 5,035,015 | A | * | 7/1991 | Maietta | 5/630 |
| 5,153,960 | A | * | 10/1992 | Ritter et al. | 5/432 X |
| 5,272,780 | A | | 12/1993 | Clute | 5/655 |
| 5,432,967 | A | | 7/1995 | Raftery | 5/633 |
| D360,796 | S | * | 8/1995 | Goldado | 5/648 X |
| 5,439,008 | A | * | 8/1995 | Bowman | 128/875 |
| D366,527 | S | * | 1/1996 | Paterson | D24/158 |
| 5,697,112 | A | * | 12/1997 | Colavito et al. | 5/633 |
| 5,727,266 | A | * | 3/1998 | Pang | 5/490 |
| 5,991,945 | A | * | 11/1999 | Pang | 5/922 X |
| 6,292,964 | B1 | * | 9/2001 | Rose et al. | 5/630 |

* cited by examiner

*Primary Examiner*—Robert G. Santos
(74) *Attorney, Agent, or Firm*—David L. Ray

(57) ABSTRACT

A support pillow for elevating the hips of a woman after sexual intercourse to facilitate entry of sperm into the uterus, the pillow including a generally wedge-shaped resilient body having a pair of generally triangular side surfaces, a sloping generally rectangular hip support surface extending between the sloping upper edge of the triangular side surfaces, a generally rectangular flat bottom surface, a rear surface connected generally perpendicular to the rear edge of the flat bottom, the wedge-shaped resilient body having a wedge-shaped piece of rigid material therein, the wedge-shaped resilient body having a soft cover thereon, the cover having a strap on each side thereof for grasping by the hands of user to position the pillow beneath the hips. Preferably the portion of the cover covering the hip support surface of the wedge-shaped resilient body has adhesive fastener strips on the top thereof, and the portion of the cover covering the rear surface of the wedge-shaped resilient body has adhesive fastener strips thereon for receiving a removable washable flap having adhesive fastener strips thereon aligned for placement on the adhesive fastener.

20 Claims, 3 Drawing Sheets

FERTILITY PILLOW

BACKGROUND OF THE INVENTION

1. Field of the Invention

The present invention is related to devices for assisting women to conceive.

2. Description of the Related Art

To assist women in becoming pregnant, many doctors advocate elevating the hips of the woman attempting to conceive for approximately thirty minutes after intercourse to facilitate entry of the sperm into the uterus. This position is extremely uncomfortable for women because they are forced to use several pillows which eventually compress under the pressure of the woman's entire body. When the pillows are compressed, the hips are no longer elevated and entry of the sperm into the uterus is no longer facilitated.

In general pillows commonly used on a bed are designed to support the head and not the entire body. Moreover, there is no support for the woman's back when her hips are elevated on commonly used pillows.

Exemplary of the patents of the related art are U.S. Pat. Nos. 2,857,957; 4,780,921; 4,802,249; 5,029,350; 5,272,780; and 5,432,967.

SUMMARY OF THE INVENTION

It is a object of the invention to provide a support pillow for comfortably elevating the hips of a woman after intercourse to facilitate entry of sperm into the uterus to increase the probability of conception.

In accordance with the present invention there is provided a support pillow for elevating the hips of a woman after sexual intercourse to facilitate entry of sperm into the uterus, the pillow including a generally wedge-shaped resilient body having a pair of generally triangular side surfaces, a sloping generally rectangular hip support surface extending between the sloping upper edge of the triangular side surfaces, a generally rectangular flat bottom surface, a rear surface connected generally perpendicular to the rear edge of the flat bottom, the wedge-shaped resilient body having a wedge-shaped piece of rigid material therein, the wedge-shaped resilient body having a soft cover thereon, the cover having a strap on each side thereof for grasping by the hands of user to position the pillow beneath the hips. Preferably the portion of the cover covering the hip support surface of the wedge-shaped resilient body has adhesive fastener strips on the top thereof, and the portion of the cover covering the rear surface of the wedge-shaped resilient body has adhesive fastener strips thereon for receiving a removable washable flap having adhesive fastener strips thereon aligned for placement on the adhesive fastener strips attached to the cover.

BRIEF DESCRIPTION OF THE DRAWINGS

The invention will be more completely understood by reference to the drawings in which.

DETAILED DESCRIPTION OF THE INVENTION

Figure 1:
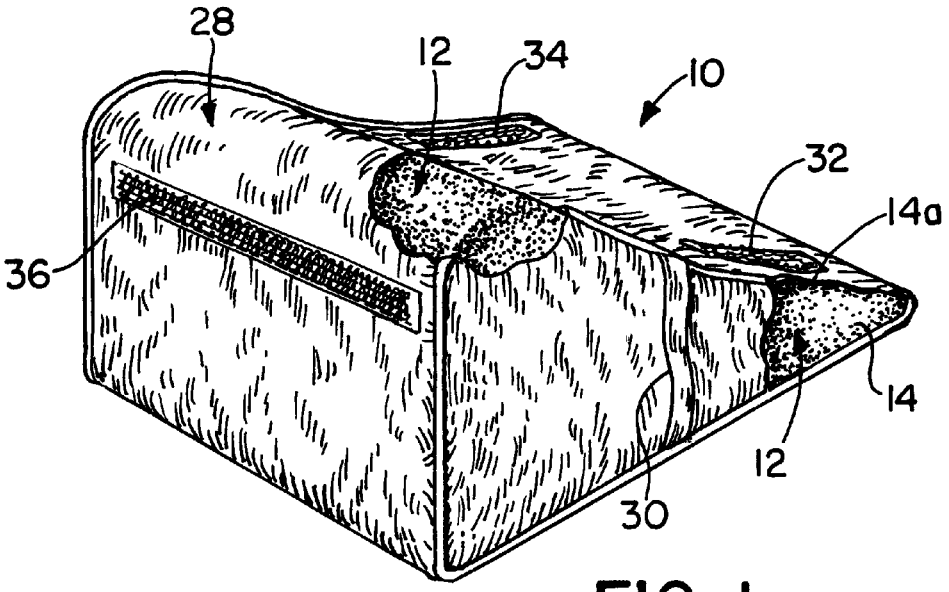
FIG. 1 is a partially cut-away perspective view of the rear and side of the fertility pillow of the invention.
Figure 2:
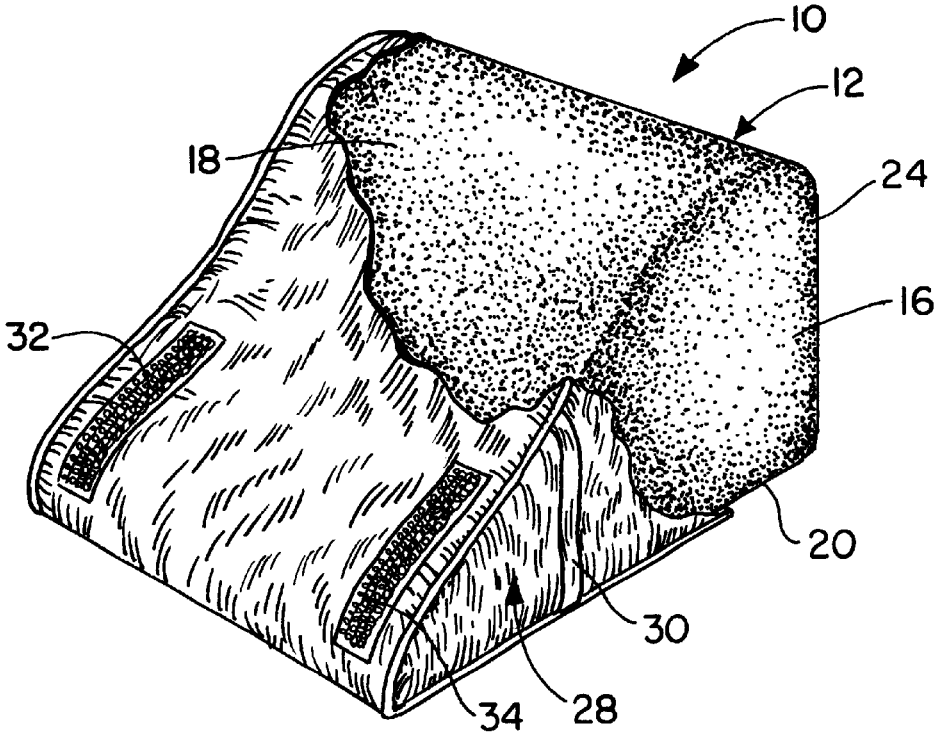
FIG. 2 is a partially cut-away perspective view of the front and side of the fertility pillow of the invention.
Figure 3:
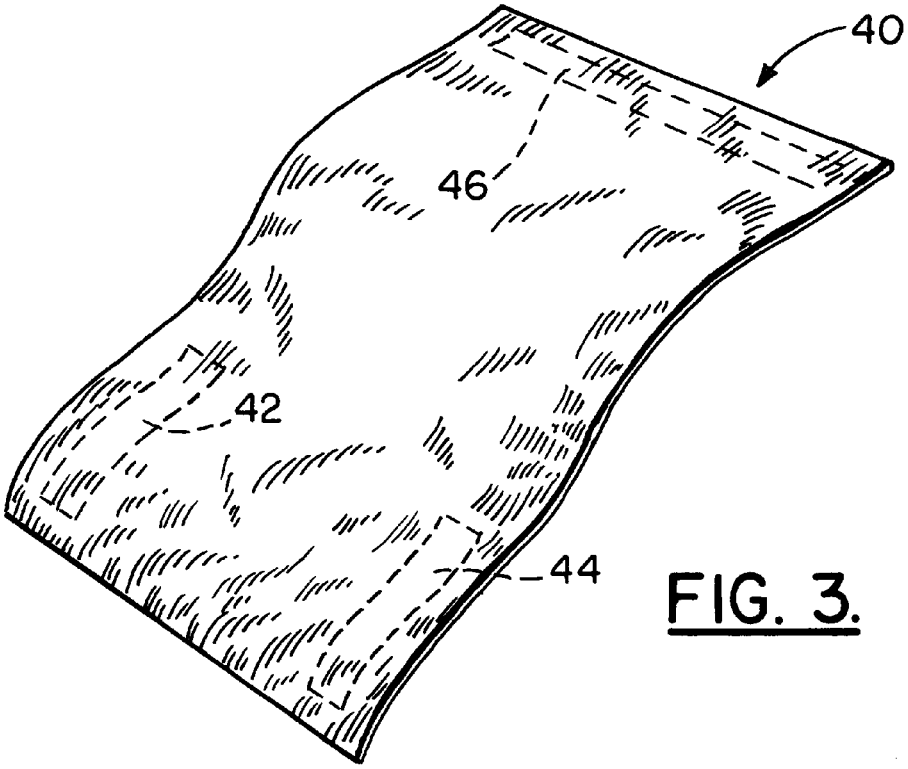
FIG. 3 is a perspective view of the top of the removable flap of the fertility pillow of the invention showing the fastener strips in phantom lines.
Figure 4:
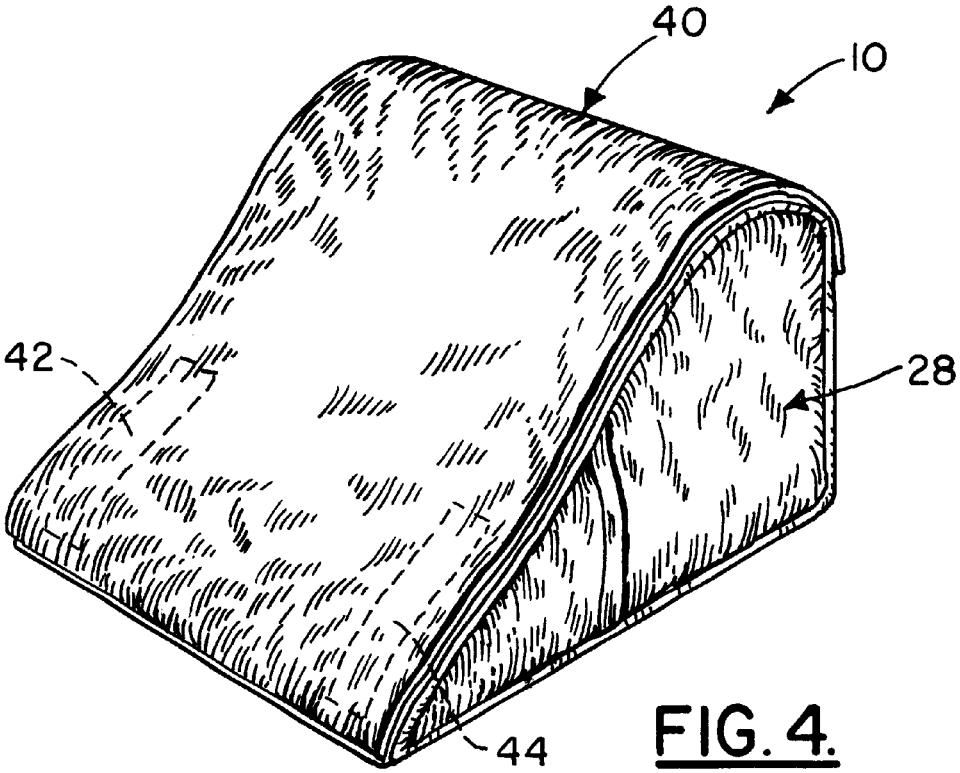
FIG. 4 is a perspective view of the front and side of the fertility pillow of the invention with the cover attached thereto and the fastener strips shown in phantom lines.

Referring now to the drawings, the fertility pillow of the invention is generally indicated by the numeral 10. Fertility pillow 10 has a generally wedge-shaped resilient body generally indicated by the numeral 12 shown in FIGS. 1, 2, 5, and 6. Preferably resilient body 12 is made from a soft, resilient foamed polymeric material such as foamed rubber or the like.

Resilient body 12 has a pair of generally triangular side surfaces 14 and 16 having sloping upper edges 14*a* and 16*a*. Triangular surfaces 14 and 16 are generally in the shape of right triangles. A sloping generally rectangular hip support surface 18 extends between the sloping upper edges 14*a* and 16*a* of the triangular side surfaces 14 and 16. Upper edges 14*a* and 16*a* are generally the hypotenuse of triangular side surfaces 14 and 16.

Figure 7:
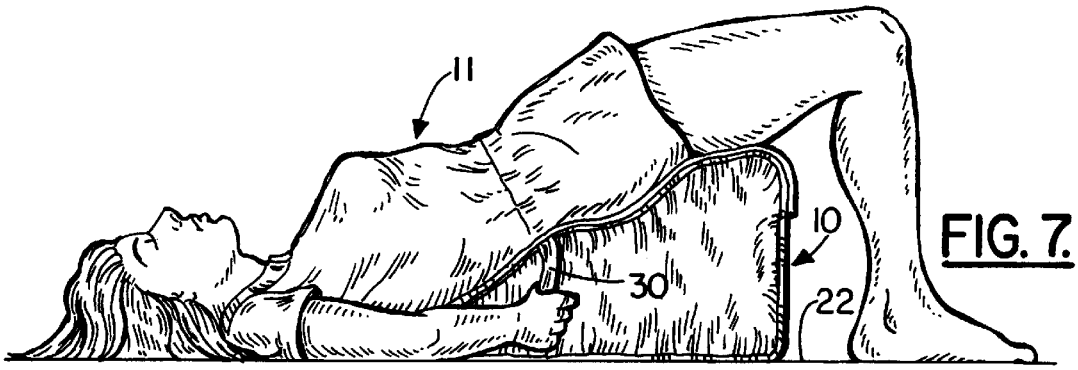
FIG. 7 is a side view of the fertility pillow of the invention in use.

The bottom surface of resilient body 12 is generally indicated by the numeral 20. Bottom surface 20 is preferably flat and generally rectangular in shape. Bottom surface 20 is oriented horizontally on the horizontal surface 22 on which fertility pillow 20 is placed as shown in FIG. 7. Horizontal surface 22 may be a bed, floor, or the like.

Located at the rear end of resilient body 12 is rear surface 24. Rear surface 12 is generally perpendicular to bottom surface 20 and to triangular surfaces 14 and 16. Preferably, rear surface 12 is generally rectangular in shape.

Figure 5:
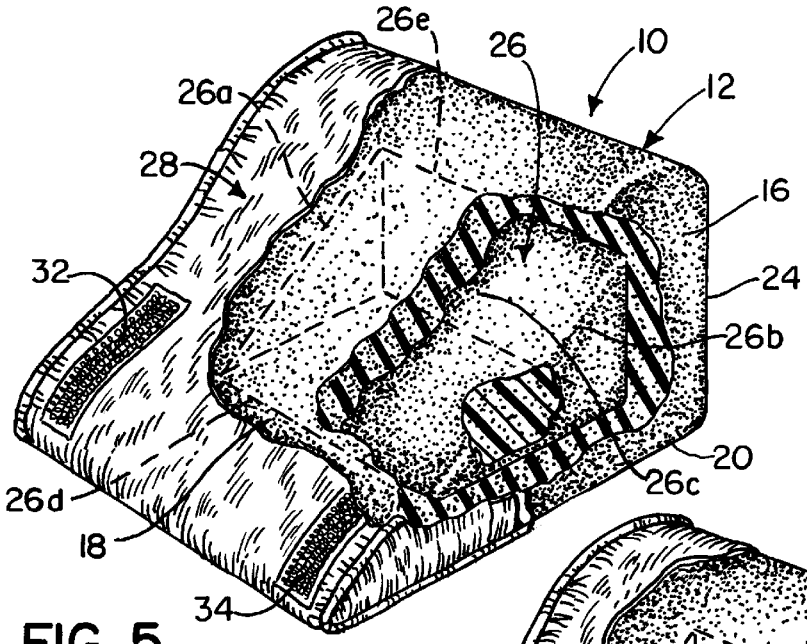
FIG. 5 is a perspective view, partially cut-away, partially cross-sectional of the fertility pillow of the invention showing the rigid interior wedge-shaped material.

As can best be seen in FIG. 5, wedge-shaped resilient body 12 has a rigid support member generally indicated by the numeral 26 located therein to provide additional support to the hips and buttocks of the user generally indicated by the numeral 11. Rigid support member 26 could be made from any rigid material. Preferably, rigid support member 26 is made from any rigid plastic material well known in the art. Also preferred for construction of rigid support member 26 is hard cardboard or styrofoam.

Preferably rigid support member 26 is wedge-shaped and has an outer shape and surface configuration which is proportionate to wedge-shaped resilient body 12, thus the outer surface of support member 26 is in general a smaller scale duplicate of body 12. Wedge-shaped rigid support member 26 has a pair of generally triangular side surfaces 26*a* and 26*b*, a sloping generally rectangular hip support surface 26*c* extending between the sloping upper edge of the triangular side surfaces 26*a* and 26*b*, a generally rectangular flat bottom surface 26*d*, and a rear surface 26*e* connected generally perpendicular to the rear edge of the flat bottom surface 26*d*. Preferably rigid support member 26 is oriented in the interior of wedge-shaped body 12 with all outer surfaces of support member 26 generally parallel and generally equidistant from corresponding surfaces of body 12. Wedge-shaped rigid support member 26 prevents wedge-shaped resilient body 12 from collapsing under the weight of the user 11 and lowering the hips of the user 11 to an undesirable angle with the horizontal.

Figure 6:
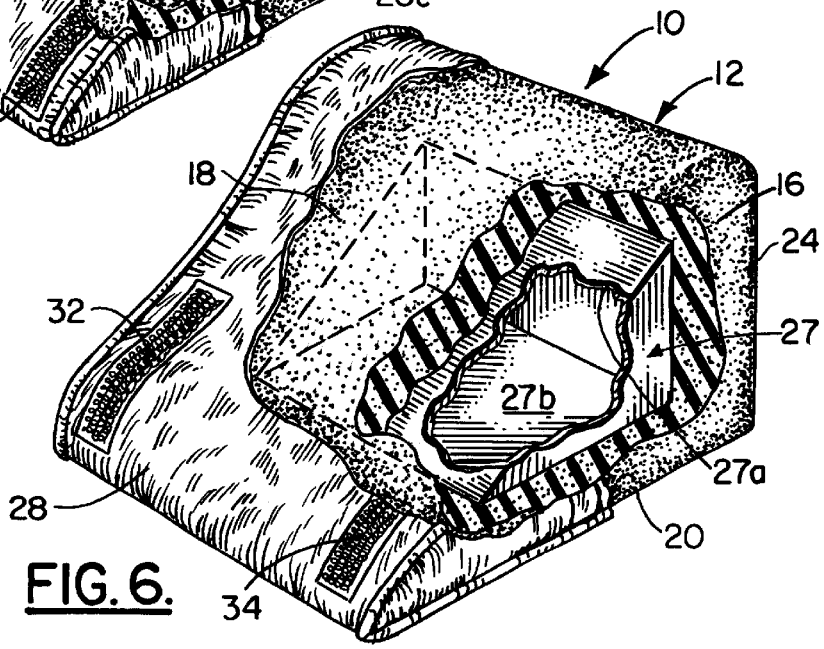
FIG. 6 is a perspective view, partially cut-away, partially cross-sectional of the fertility pillow of the invention showing the rigid interior wedge-shaped material to be hollow.

An alternate embodiment of the wedge-shaped rigid support member 26 is shown in FIG. 6 and is generally indicated by the numeral 27. Wedge-shaped rigid support member 27 is identical in outer shape and in location inside of body 12. However, wedge-shaped rigid support member 27 is hollow inside. Wedge-shaped rigid support member 27 has rigid walls 27*a* and a hollow interior 27*b*. The rigid walls of wedge-shaped rigid support member 27 could be made from any rigid support member desired, although the preferred materials are polymeric materials and the like.

Wedge-shaped resilient body 12 preferably has a soft fabric cover generally indicated by the numeral 28 thereon. Soft fabric cover 28 is preferably sewn together to snugly enclose body 12 therein as known in the art. If desired, a closure such as a zipper could be incorporated in one or more edges of cover 28 to enable the cover to be zipped open and body 12 inserted therein.

Preferably, cover 28 has a strap 30 on each side thereof for grasping by the hands of user 11 to position the pillow beneath the hips. Preferably the portion of the cover 28 covering the hip support surface 18 of the wedge-shaped resilient body 12 has adhesive fastener strips 32 and 34 on the outer surface thereof, and the portion of the cover 28 covering the rear surface 24 of the wedge-shaped resilient body has adhesive fastener strip 36 thereon for receiving a removable washable flap generally indicated by the numeral 40. Flap 40 has adhesive fastener strips 42, 44, and 46 thereon aligned for placement on the adhesive fastener strips 32, 34, and 36 attached to cover 28. Fasteners 32, 34, 36, 42, 44, and 48 are preferably hook and pile or hook and loop closures, and are well known in the art. One type of hook and loop closure is that described in U.S. Pat. No. 3,4143,033 and sold under the trademark "Velcro".

Although the preferred embodiments of the invention have been described in detail above, it should be understood that the invention is in no sense limited thereby, and its scope is to be determined by that of the following claims:

What is claimed is:

1. A support pillow for elevating the hips of a woman after sexual intercourse to facilitate entry of sperm into the uterus to increase the probability of conception, the pillow comprising:

a. a generally wedge-shaped resilient body having:
   i. a pair of generally triangular side surfaces,
   ii. a sloping hip support surface extending between said triangular side surfaces,
   iii. a bottom surface,
   iv. a rear surface connected to the rear edge of said bottom surface,
   vi. a wedge-shaped rigid support member completely enclosed in said wedge-shaped resilient body for preventing said wedge-shaped resilient body from collapsing, b. a pair of straps on each side surface of said pillow for grasping by the hands of user to position the pillow beneath the hips.

2. The pillow of claim 1 wherein said wedge-shaped resilient body has a cover thereover.

3. The pillow of claim 2 wherein said cover is soft fabric.

4. The pillow of claim 2 wherein said pair of straps are connected to said cover.

5. The pillow of claim 4 wherein the portion of said cover which covers said hip support surface and said rear surface has first fasteners thereon.

6. The pillow of claim 5 wherein a removable fabric flap is connected to said by said first fasteners, said fabric flap having second fasteners thereon which are connectable to said first fasteners.

7. The pillow of claim 6 wherein said fasteners are strips of hook and loop material.

8. The pillow of claim 1 wherein said wedge-shaped rigid support member is smaller in size and identical in shape to said wedge-shaped resilient body.

9. The pillow of claim 8 wherein said rigid support member is oriented in the interior of said wedge-shaped resilient with all outer surfaces of said wedge-shaped support member generally parallel and generally equidistant from corresponding surfaces of said wedge-shaped resilient body.

10. A support pillow for elevating the hips of a woman reclining thereon after sexual intercourse to facilitate entry of sperm into the uterus to increase the probability of conception, the pillow comprising:

a. a generally wedge-shaped resilient body having:
   i. a pair of generally triangular side surfaces,
   ii. a sloping hip support surface extending between said triangular side surfaces,
   iii. a bottom surface,
   iv. a rear surface connected to the rear edge of said bottom surface,
   vi. a wedge-shaped rigid support member completely enclosed in said wedge-shaped resilient body for preventing said wedge-shaped resilient body from collapsing, b. a cover enclosing said wedge-shaped resilient body, said cover having a pair of straps on each side surface thereof adjacent to said generally triangular side surfaces for grasping by the hands of user to position the pillow beneath the hips.

11. The pillow of claim 10 wherein said cover is soft fabric.

12. The pillow of claim 10 wherein the portion of said cover which covers said hip support surface and said rear surface has first fasteners thereon.

13. The pillow of claim 12 wherein a removable fabric flap is connected to said by said first fasteners, said fabric flap having second fasteners thereon which are connectable to said first fasteners.

14. The pillow of claim 13 wherein said fasteners are strips of hook and loop material.

15. The pillow of claim 10 wherein said wedge-shaped rigid support member is smaller in size and identical in shape to said wedge-shaped resilient body.

16. The pillow of claim 15 wherein said rigid support member is oriented in the interior of said wedge-shaped resilient body with all outer surfaces of said wedge-shaped support member generally parallel and generally equidistant from corresponding surfaces of said wedge-shaped resilient body.

17. A support pillow for elevating the hips of a woman reclining thereon after sexual intercourse to facilitate entry of sperm into the uterus to increase the probability of conception, the pillow comprising:

a. a generally wedge-shaped resilient body for supporting the hips of a woman, said body having:
   i. a pair of generally triangular side surfaces,
   ii. a sloping hip support surface extending between said triangular side surfaces,
   iii. a bottom surface,
   iv. a rear surface connected to the rear edge of said bottom surface,
   vi. a wedge-shaped rigid support member completely enclosed in said wedge-shaped resilient body for preventing said wedge-shaped resilient body from collapsing, b. hand grasping means connected to said pillow for grasping by the hands of user to position said pillow beneath said hips.

18. The pillow of claim 17 wherein said wedge-shaped resilient body has a cover thereover.

19. The pillow of claim 18 wherein said cover is soft fabric.

20. The pillow of claim 18 wherein said hand grasping means are connected to said cover.

* * * * *